US005218411A

United States Patent [19]

Kosugiyama et al.

[11] Patent Number: 5,218,411

[45] Date of Patent: Jun. 8, 1993

[54] SHEET CONVEYING DEVICE WITH CURL REDUCTION FEATURE

[75] Inventors: Otoya Kosugiyama, Tsunashimahigashi; Makoto Shikada, Kawasaki, both of Japan

[73] Assignee: Canon Kabushiki Kaisha, Tokyo, Japan

[21] Appl. No.: 824,087

[22] Filed: Jan. 22, 1992

[30] Foreign Application Priority Data

Jan. 23, 1991 [JP] Japan ..... 3-022875

[51] Int. Cl.[5] ..... G03G 15/20

[52] U.S. Cl. ..... 355/285; 355/30; 355/321; 271/185; 162/197; 162/271

[58] Field of Search ..... 355/309, 308, 318, 320, 355/321, 282, 285, 290, 30; 271/303, 184, 186, 188, 16, 19, 161, 209; 162/197, 271

[56] References Cited

U.S. PATENT DOCUMENTS 4,326,915 4/1982 Mutschler ..... 162/271
4,545,671 10/1985 Anderson ..... 355/309
4,579,446 4/1986 Fujino et al. ..... 355/24
4,591,259 5/1986 Kuo et al. ..... 271/188 X
5,017,970 5/1991 Sakata ..... 355/290
5,032,875 7/1991 Gooray et al. ..... 355/290
5,066,984 11/1991 Coombs ..... 355/309

OTHER PUBLICATIONS

Abstract of Japanese Kokai 62-150276 Published Jul. 1987.

Abstract of Japanese Kokai 2-273773 Published Nov. 1990.

*Primary Examiner*—R. L. Moses

*Attorney, Agent, or Firm*—Fitzpatrick, Cella, Harper & Scinto

[57] ABSTRACT

A sheet conveying device includes a fixing unit for fixing an image formed on a sheet by heating the sheet, a conveying path for guiding the sheet fixed by the fixing unit while bending the sheet, and a cooling device for selectively cooling the sheet guided along the conveying path.

32 Claims, 8 Drawing Sheets

SHEET CONVEYING DEVICE WITH CURL REDUCTION FEATURE

BACKGROUND OF THE INVENTION

1. Field of the Invention

This invention relates to a discharged-sheet conveying device in an image forming apparatus, such as a copier, a printer or the like, which uses an electrophotographic process, and more particularly, to a heat radiation control mechanism in a discharged-sheet conveying device which uses a thermal fixing process.

2. Description of the Related Art

FIG. 8 shows a conventional printer 100 which uses an electrophotographic process. In FIG. 8, there is shown a main body 1 of the printer. A cassette 2 for accommodating sheets of a recording material P is mounted on the right side of the main body 1. A single sheet of the recording material P is fed from the cassette 2 by a sheet feed roller 3. The sheet of the recording material P is fed between guides 5 and 6 to a photosensitive drum 9 at a predetermined timing by sheet feed roller 3 and a pair of registration rollers 7, and a toner image on the photosensitive drum 9 is transferred onto the sheet by a transfer roller 10. A process cartridge 11 includes a cleaning unit, a primary charger, a developing unit and the like. The sheet of the recording material P having the image transferred thereto is conveyed on a conveying guide 12 to a fixing unit 13.

The fixing unit 13 includes an entrance guide 13*a* and an exit guide 13*b*. A fixing roller 16 made of aluminum and including a halogen heater 15 is provided at an upper portion of the fixing unit 13. An elastic pressing roller 17 made of rubber is in pressure contact with the fixing roller 16 from below. Next to the exit guide 13*b* there are provided a pair of sheet discharge rollers 19, a flapper 20 for guiding the sheet of the recording material P in a horizontal or upward direction, and an upwardly directing sheet discharge guide 21 above the flapper 20. A sheet discharge roller 22 and a pair of uncurling rollers 23 are provided in pressure contact with each other at a horizontally directing distal end of the sheet discharge guide 21.

A sheet discharge tray 25 for facedown sheet discharge is provided on the upper surface of the main body 1 at a lower right side of the sheet discharge roller 22. A sheet discharge tray 26 for faceup sheet discharge which can be opened and closed outside the main body 1 and has a substantially horizontal posture when it is opened is provided at the left side of the sheet discharge rollers 19.

A scanner unit 27 scans laser light. A mirror 29 guides the laser light to the photosensitive drum 9.

A printing operation will now be explained. When a printing operation is initiated by a host computer (not shown) connected to the printer 100, the sheet feed roller 3 rotates to feed a sheet of the recording material P from within the cassette 2. The sheet is guided to the registration rollers 7 by the guide 6. The registration rollers 7 convey the sheet to the transfer position in synchronization with image information formed on the photosensitive drum 9 by the laser light. After an image has been transferred to the sheet, the sheet is fed to the fixing unit 13, where a fixing process is performed using heat and pressure. The flapper 20 is linked to sheet discharge tray 26 and moves in synchronization with opening/closing of the sheet discharge tray 26. When the sheet discharge tray 26 is opened (as indicated by two-dot chain lines), the flapper 20 is at a position indicated by broken lines. After the fixing process, the sheet is linearly conveyed, and is discharged and mounted onto the sheet discharge tray 26 with the image faced up (faceup sheet discharge) by the sheet discharge rollers 19. When the sheet discharge tray 26 is closed, the flapper 20 is at a position indicated by solid lines. The sheet is upwardly conveyed, and is discharged onto the sheet discharge tray 25 for facedown sheet discharge with the image faced down by the sheet discharge roller 22 and the uncurling rollers 23.

Since the sheet of the recording material P is subjected to a temperature between 150° C. and 180° C. and a pressure of about 7 kg in the fixing process, upward curling is produced along a nip shape formed by the fixing roller 16 and the pressing roller 17.

When the sheet of the recording material P is discharged onto the tray 26 for faceup sheet discharge, the sheet is conveyed with a slightly downward bent by the flapper 20 before the temperature of the sheet decreases. Hence, the sheet is discharged onto the sheet discharge tray 26 in a substantially uncurled state.

When the sheet of the recording material P is discharged onto the sheet discharge tray 25 for facedown sheet discharge, the sheet curl is increased by the outwardly convex sheet discharge guide 21 after the fixing process. After the curling of the sheet is reduced by an upwardly pressing force of the uncurling rollers 23 pressed against the sheet discharge roller 22, and the upwardly curved conveying path provided by the sheet discharge roller 22 and the uncurling rollers 23, the sheet is discharged and mounted onto the tray 25 for facedown sheet discharge.

However, since the recording material P may comprise paper or OHP sheets, the state of the generation of curling differs according to a difference in the property of the recording material used.

When paper is used, the amount of curling is increased as the temperature of the paper is higher if the paper is passed through a curved conveying surface.

A large degree of curling is produced particularly at temperatures higher than about 50° C. It is possible to reduce or eliminate the curling by passing the paper through an inversely curved conveying surface. Alternately, the paper may be discharged after being conveyed in a flat state until the temperature of the paper is below 50° C. (faceup sheet discharge).

When an OHP sheet is used, the shape of the sheet starts to deform at a temperature of between 55° C. and 80° C. The sheet is softened above 80° C. and is hardened below 55° C. Curling is not produced and hardly changes in any of the above-described conditions. Accordingly, in order to reduce curling in an OHP sheet, the sheet must be discharged in a high-temperature state, and must be cooled while stacking the sheet on a plane sheet discharge tray.

That is, when paper is used, either the paper must be subjected to faceup sheet discharge, or uncurling rollers must be added to a sheet discharge roller when the paper is subjected to facedown sheet discharge, since a sheet discharge guide promotes curling of the paper. Even when an OHP sheet is used, the sheet must be discharged before it cools down, that is the sheet must be subjected to faceup sheet discharge. Hence, conventional approaches have disadvantages in that the space for installing a printer will be increased due to the presence of a tray for faceup sheet discharge, and the production cost will be increased due to the provision of the tray for faceup sheet discharge or the uncurling rollers.

SUMMARY OF THE INVENTION

It is an object of the present invention to provide a sheet conveying device in an image forming apparatus which can discharge a sheet of a recording material with a minimum amount of curling, whether the recording material comprises paper or OHP sheets, by providing a recording material conveying guide which swings between positions to open and close the path of an air flow introduced from the outside into a sheet conveying path between a fixing unit and the sheet conveying path.

According to one aspect of the present invention, there is provided a discharged-sheet conveying device in an electrophotographic image forming apparatus comprising a fixing unit which comprises a fixing rolle, incorporating a heater, and a pressing roller for elastically pressing the fixing rolle, and a discharged-sheet conveying path for guiding a sheet of a recording material discharged from the fixing unit, a recording material conveying guide, which swings between a first position (indicated by solid lines) and a second position (indicated by broken lines) so that the path of an air flow introduced from the outside to within the discharged-sheet conveying path is open at the first position and is closed at the second position, is provided between the fixing unit and the discharged-sheet conveying path.

According to the above-described configuration, the sheet of the recording material having an image transferred thereto is heated by the fixing roller heated by the heater and at the same is pressed by the pressing roller to fix the image on the sheet. Subsequently, the sheet is guided and discharged by the discharged-sheet conveying path. At that time, when the recording material comprises, for example, paper, the sheet discharged guide is set at the first position in order to cool the sheet by the air flow introduced from the outside, whereby the amount of curling of the sheet is reduced. When, the recording material comprises, for example, an OHP sheet, the discharge guide is set at the second position in order to cut the air flow introduced from the outside, whereby the temperature of the sheet is maintained by reducing heat radiation. Thus, the amount of curling will be reduced by maintaining the OHP sheet at a temperature higher than about 85° C. hardly produces curling.

DETAILED DESCRIPTION OF THE PREFERRED EMBODIMENTS

Embodiments of the present invention will now by explained with reference to the drawings.

Figure 8:
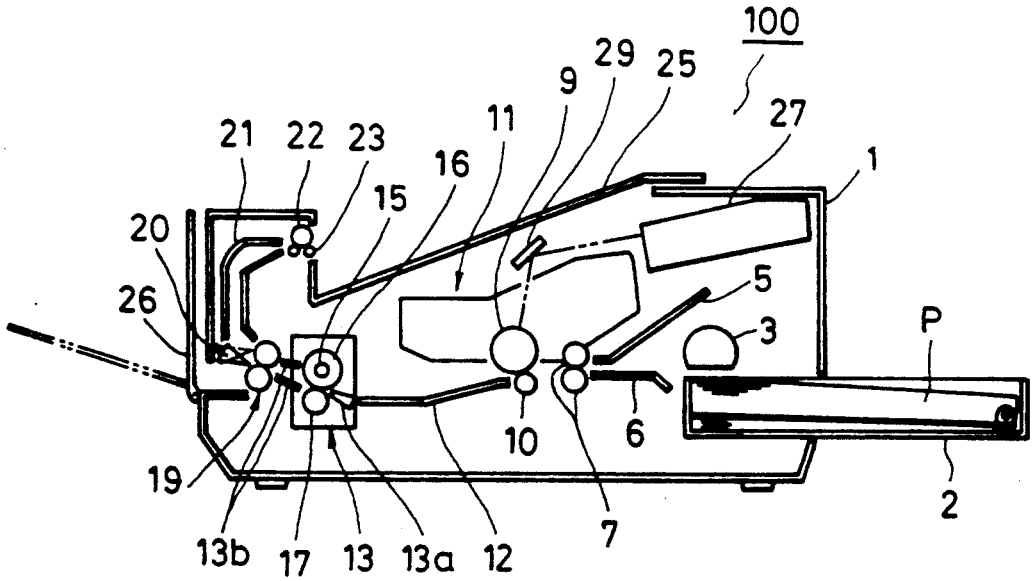
FIG. 8 PRIOR ART
FIG. 8 is a cross-sectional side view of a conventional printer.

While the conventional printer 100 has been explained with reference to FIG. 8 in the description of the related art, the printer 100 may also be adopted as the printer of the present invention, Hence, the components and units having the same configurations and functions as those shown in FIG. 8 are indicated by the same reference numerals, and an explanation thereof will be omitted. However, members in or connected to the fixing unit 13 having different configurations and functions are indicated by different reference numerals. These members will be explained in detail with reference to FIG. 1. Common members of the printer 100 are also used in the printer of the present invention.

Figure 1:
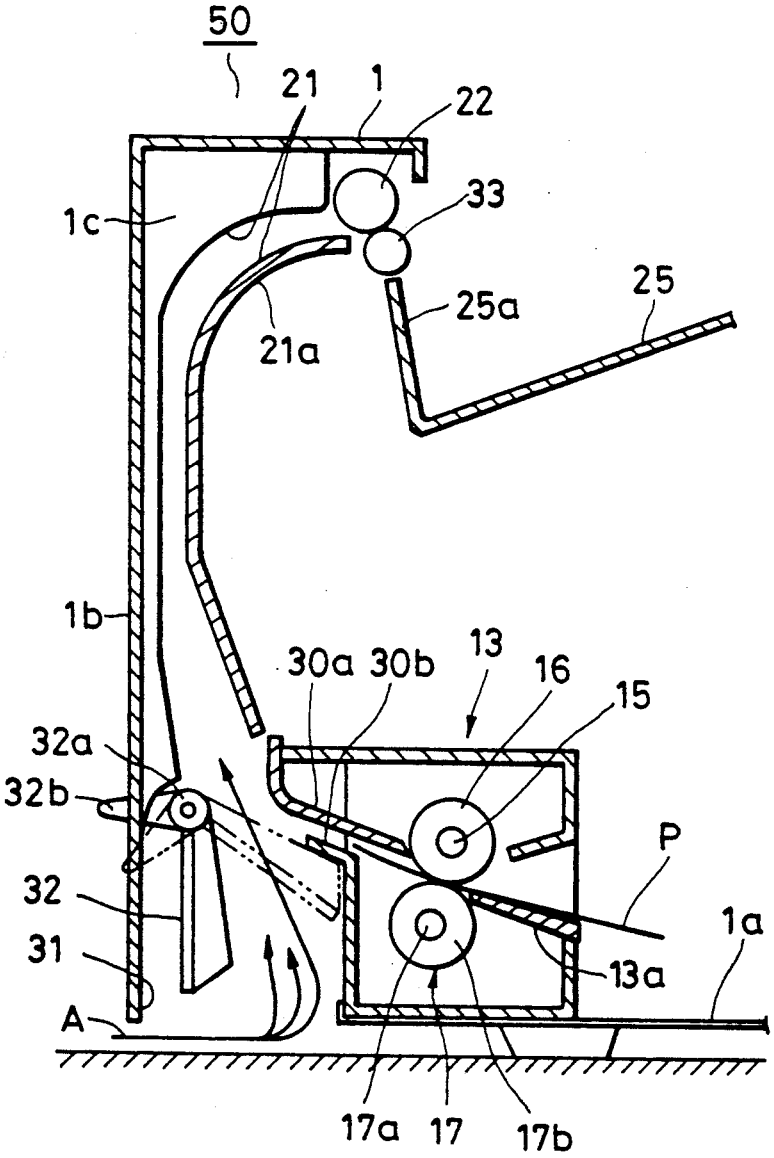
FIG. 1 is a crossed-sectional side view of a discharged-sheet conveying device according to an embodiment of the present invention.

FIG. 1 shows a discharged-sheet conveying unit 50. The fixing unit 13 functions in the same manner as described above. The pressing roller 17 comprises a core bar 17*a* and an elastic roller 17*b* made of rubber, and is in pressure contact with the fixing roller 16 with a pressure of about 7 kg. An exit guide 30*a*, 30*b* is provided only at an upper portion.

The fixing unit 13 is provided at a left end portion of a floor member 1*a* of the main body 1. A ventilating hole 31 is provided between the left side of the fixing unit 13 and a left side wall 1*b* of the main body 1. The sheet discharge guide (the sheet conveying path) 21 is formed by a rib 1*c* provided at the side wall 1*b* and a guide plate 21*a*.

A driven roller 33 is in pressure contact with the sheet discharge roller 22 so as to provide a sheet of the recording material P guide by the guided plate 21*a* with upward curling, i.e., to uncurl the sheet. There is also shown a side wall 25*a* of the sheet discharge tray 25.

A flapper guide 32 is pivotally supported on a support shaft 32*a* provided at a lower portion of the rib 1*c* of the side wall 1*b*. A knob 32*b* of the flapper guide 32 is seen outside the device. When the flapper guide 32 is at a position indicated by two-dot chain lines, it closes the sheet conveying path from the outside and guides the sheet.

The operation of the present embodiment will now be explained.

When the recording material P comprises paper, the flapper guide 32 is set to a position indicated by solid lines (an opened position) by manually lifting lever 32*b*.

After the fixing process, the sheet of the recording material P is separated from the fixing roller 16 and supported on air flow A, having been conveyed along exit guides 30*a* and 30*b*, is further guided in an upward direction by the sheet discharged guide 21, and is discharged in a facedown condition onto the sheet discharge tray 25 by the sheet discharge roller 22 and the driven roller 33.

At time, the sheet first radiates heat in a downward direction due to the air flow A, and is further cooled in the sheet discharge guide 21.

The temperature of the sheet decreases about 3°–4° C. due to the above-described cooling, whereby it is possible to prevent additional upward curling due to the curvature of at entry to guide 21 and at the end portion of the sheet discharge guide 21. Upward curling produced at the fixing portion (downward curling is produced by the rollers 22 and 33) is reduced due to the inversely curved path provided by the sheet discharge roller 22 and the driven roller 33 (The amount of curling is reduced by about 10 mm from 20 mm to 10 mm).

When the recording material P comprises an OHP sheet, the operator first sets the sheet to a position indicated by broken lines by depressing the lever **32*b* of the flapper guide 32**.

Depressing lever **32*b* also closes air flow A, whereby the air immediately after the fixing unit 13 and the air within the sheet discharge guide 21** are maintained at high temperatures.

Although a temperature decrease of about 10° C. takes place in the sheet, a temperature above about 85° C. where curling hardly occurs is maintained until the sheet is discharged. As a result, a conventional amount of curling of 12 mm has been reduced to 7 mm. That is, the amount of curling has been reduced by about 5 mm.

As explained above, it is possible to maintain the temperature of an OHP sheet and to cool paper by switching the position of flapper 32. It is thereby possible to perform facedown sheet discharge while reducing the amount of curling in both the OHP sheet and paper. Hence, the present embodiment has advantages a tray for faceup sheet discharge is unnecessary, whereby the space for installing a printer can be reduced, and the production cost can be reduced since uncurling rollers can be omitted by merely changing the mounting attitude of the sheet discharge rollers 22 and 33.

Another embodiment of the present invention will now be explained with reference to FIG. 2.

Figure 2:
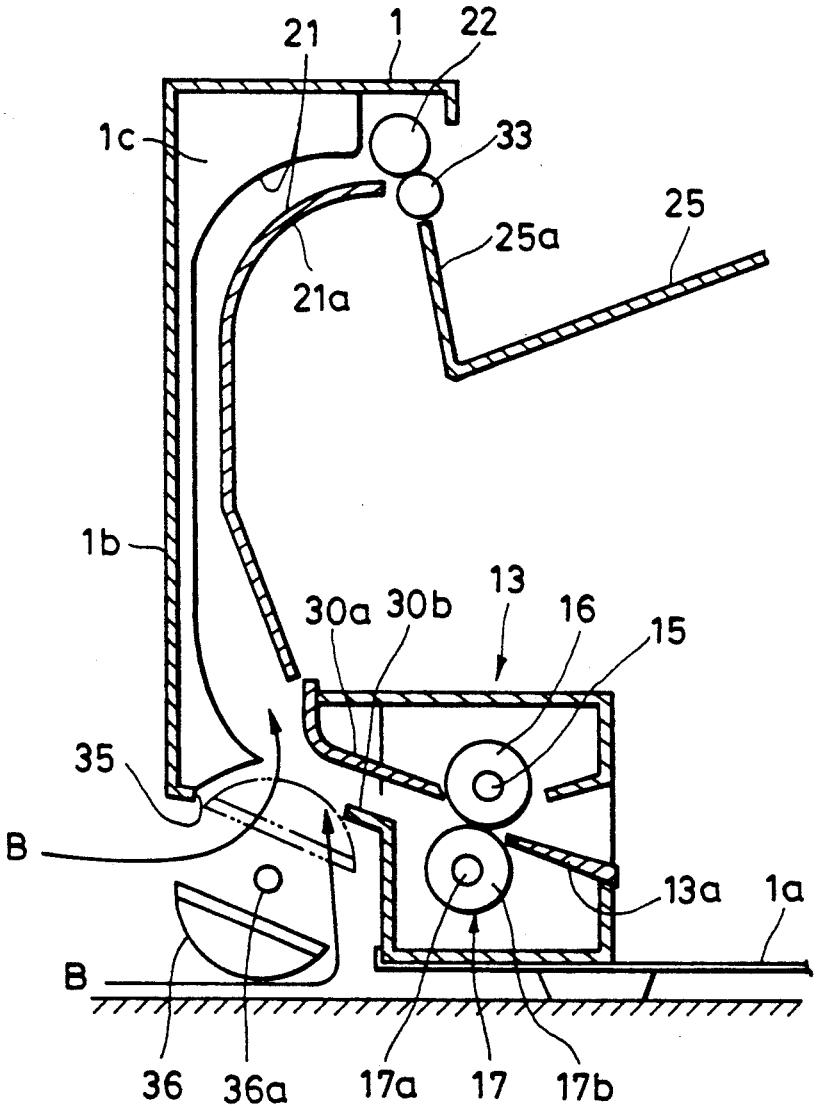
FIG. 2 is a cross-sectional side view of a discharged-sheet conveying device according to another embodiment of the present invention.

In FIG. 2, the side wall **1*b* is shorter than in the above-described embodiment for providing a ventilation hole 35. A support shaft 36*a* is provided at a substantially central portion of the ventilating hole 35. A plate-like flapper guide 36, which is eccentric with respect to the support shaft 36*a*, is pivotally supported on the support shaft 36*a***.

When the flapper guide 36 is at a position indicated by solid lines, it opens air flow B. When the flapper guide 36 is at a position indicated by two-dot chain lines, it closes the air flow B. The knob of the flapper guide 36 is not shown.

The functions and effects of the present embodiment are the same as those of the above-described first embodiment.

A still another embodiment of the present invention will now be explained with reference to FIG. 3.

Figure 3:
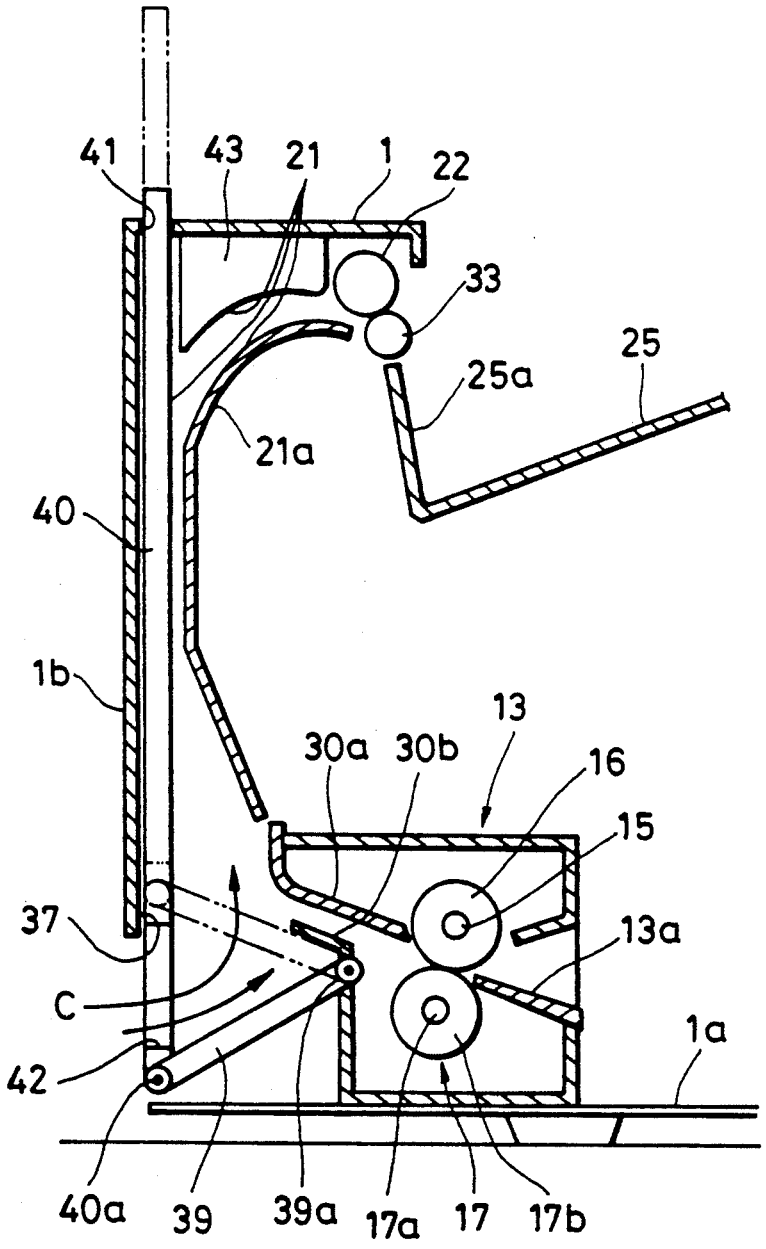
FIG. 3 a cross-sectional side view of a discharged-sheet conveying device according to still another embodiment of the present invention.

In FIG. 3, a support shaft **39*a* is provided below the exit guide 30*a*, 30*b*. A plate-like flapper guide 39 is pivotally supported on the support shaft 39*a*, and a distal end of the flapper guide 39 is pivotally supported on a lower end of a guide plate 40 by a support shaft 40*a*. The guide plate 40 is arranged so as to vertically move in a hole 41 provided in the upper wall of the main body 1 substantially along the side wall 1*b*. A louver hole 42 is provided at a lower end portion of the guide plate 40**.

A rib 43 is provided downwardly from the upper wall of the main body 1. The sheet discharge guide 21 is formed by the rib 43, the guide plate 40 and the guide plate **21*a*. There is also shown a ventilating hole 37**.

If the flapper guide 39 is set to a position indicated by two-dot chain lines by raising the guide plate 40, air flow C is closed. If the flapper guide 39 is set to a position indicated by solid lines by lowering the guide plate 40, the air flow C is formed by the louver hole 42 and the ventilating hole 37.

Although the present embodiment has the same effects as in the first embodiment, the present embodiment operates by raising and lowering the guide plate 40, while the first embodiment operates by raising and lowering lever **32*b* (see FIG. 1**).

Still another embodiment of the present invention will now be explained with reference to FIGS. 4 through 7.

Figure 4:
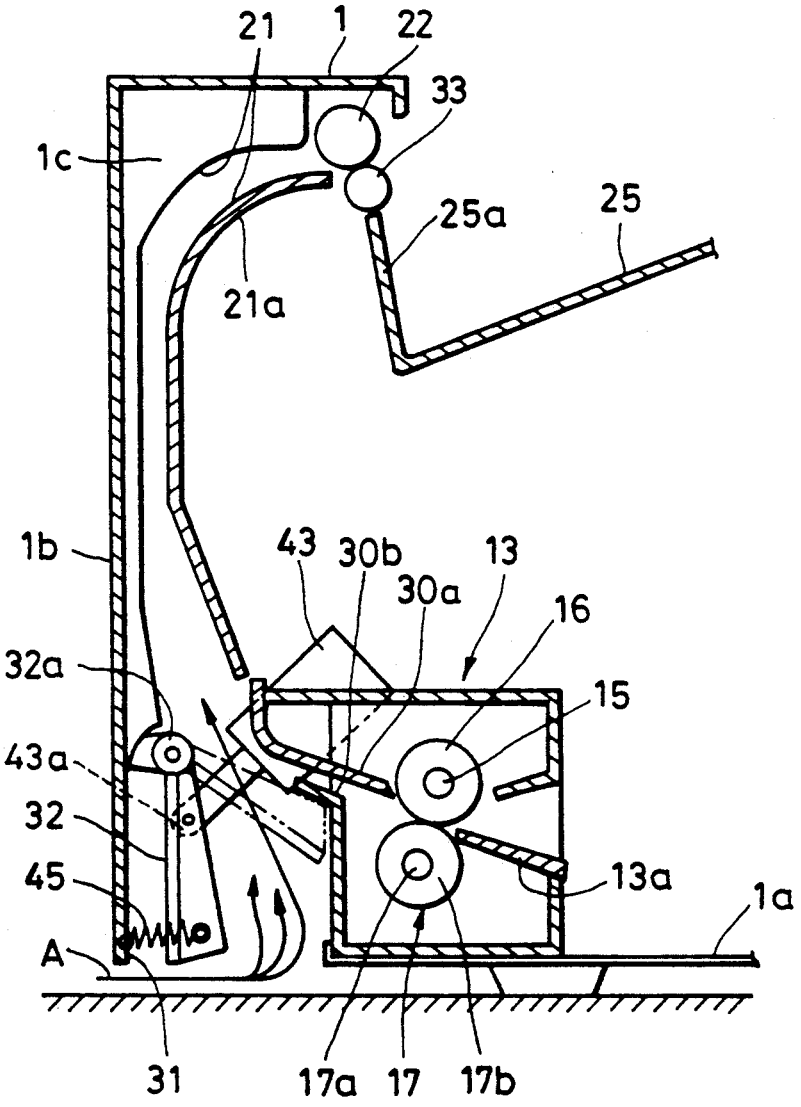
FIG. 4 is a cross-sectional side view of a discharged-sheet conveying device according to still another embodiment of the present invention.

In the configuration shown in FIG. 4, the flapper guide 32 shown in FIG. 1 is driven by a solenoid 43. A distal end of a push rod **43*a* of the solenoid 43 is connected to an intermediate portion of the flapper guide 32, and a return spring 45 is interposed between the distal end of the flapper guide 32 and a lower end portion of the side wall 1*b***.

Figure 5:
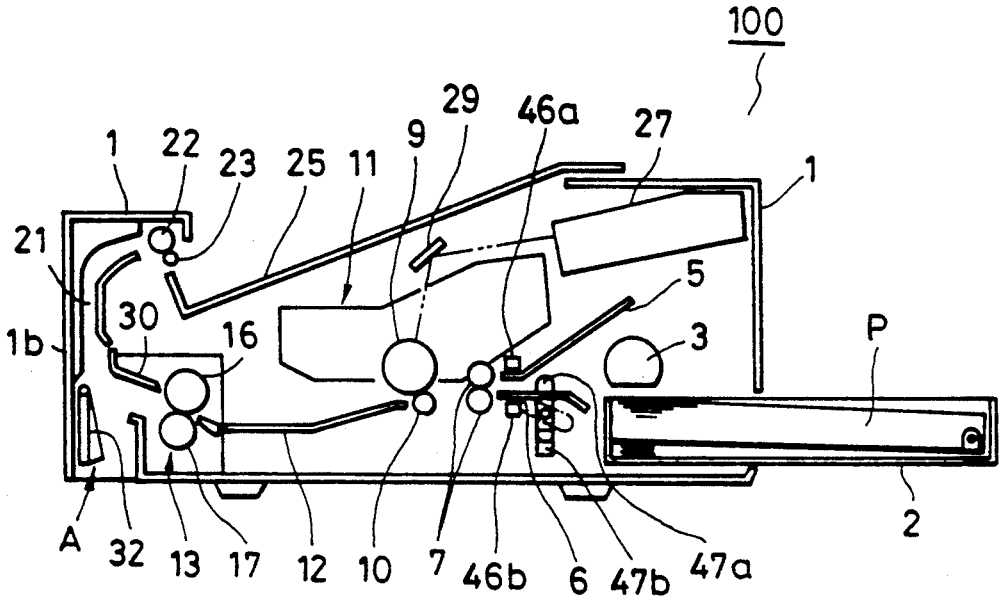
FIG. 5 is a cross-sectional side view of a printer according to still another embodiment of the present invention.

In the configuration shown in FIG. 5, there is shown apparatus for automatically determining whether the recording material is paper or OHP sheets, and setting the flapper 32 accordingly. A photosensor comprising a light-emitting device **46*a* and a photosensing device 46*b* is provided on the guides 5 and 6, respectively, all upstream relative to the registration rollers 7, and a registration sensor lever 47*a* and a registration sensor 47*b*** are provided in front of (at sides upstream from) the photosensors.

Figure 6:
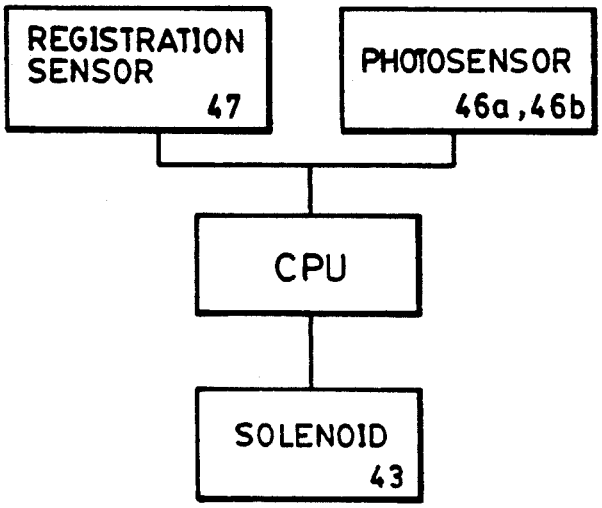
FIG. 6 is a block diagram of the FIG. 5 embodiment.

FIG. 6 is a block diagram showing the relationship among the sensors, a CPU serving as a control unit, and the solenoid.

Figure 7:
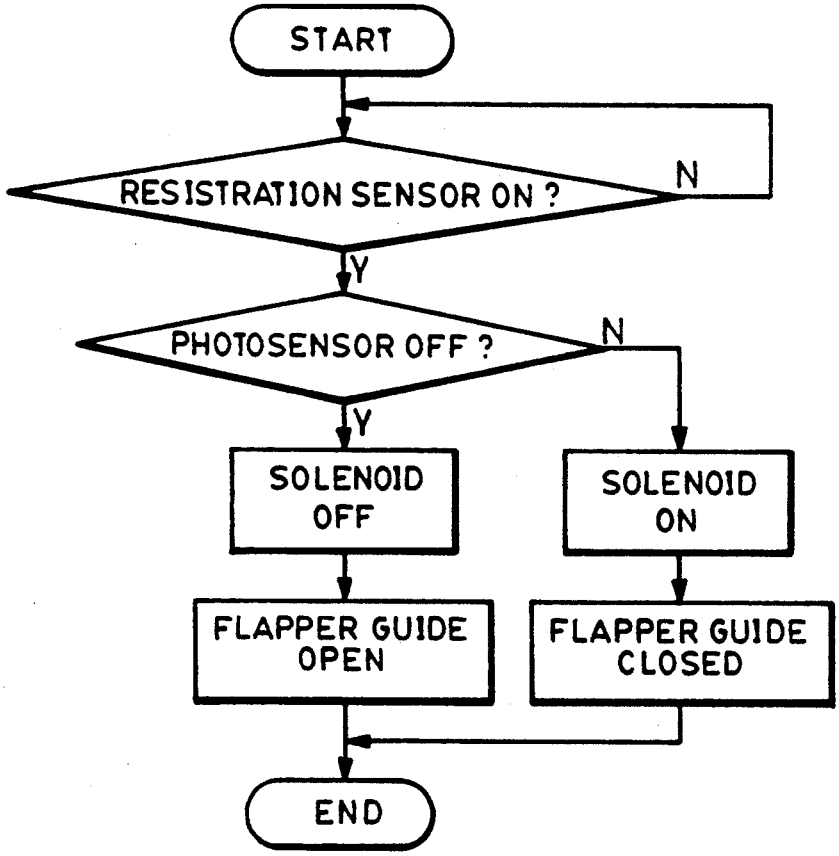
FIG. 7 is a flowchart of an operation of the FIG. 5 embodiment.

FIG. 7 is a flowchart to determine opening/closing of the flapper guide.

The function of the present embodiment will now be explained.

When a sheet of the recording material P has reached the registration rollers 7, the sheet rotates the registration sensor lever **47*a* from the state indicated by the solid lines, that is, the state wherein the registration sensor 47*b* is turned off, to the state indicated by the broken lines, that is, the state wherein the registration sensor 47*b* is turned on. When the registration sensor 47*b* has been turned on, the photosensor is operated. When light from the light-emitting device 46*a* is blocked so as not to be incident upon the photosensing device 46*b*, that is, when the photosensor is turned off, the recording material P is determined to be paper. Hence, the solenoid 43 remains turned off to open the flapper guide 32**, whereby the air flow A is formed.

When light from the light-emitting device **46*a* is not blocked and is thus incident upon the photosensing device 46*b*, that is, when the photosensor is turned on, the recording material is determined to be an OHP sheet. Hence, the solenoid 43 is turned on by a signal from the photosensor 46*a*, and the flapper guide 32** closes the ventilating hole.

Although the present embodiment performs the same functions as the foregoing embodiments, the operation of the present embodiment is automated, whereby the operability of the device will be enhanced.

Although the above-described embodiments have been described illustrating printers, the present invention is not limited to printers, but may be applied to all electrophotographic image forming apparatuses.

As explained above, according to the present invention, a recording material conveying guide is provided between a fixing unit and a sheet discharge guide. The recording material conveying guide is set to a position to open air flow when the recording material comprises paper, and to close the air flow when the recording material comprises an OHP sheet. Hence, paper discharged from the fixing unit and guided to the sheet discharge guide is cooled by the air flow, and the temperature of an OHP sheet is maintained. As a result, it is possible to reduce curling of the sheet in a discharged state in either case.

Figure 9:
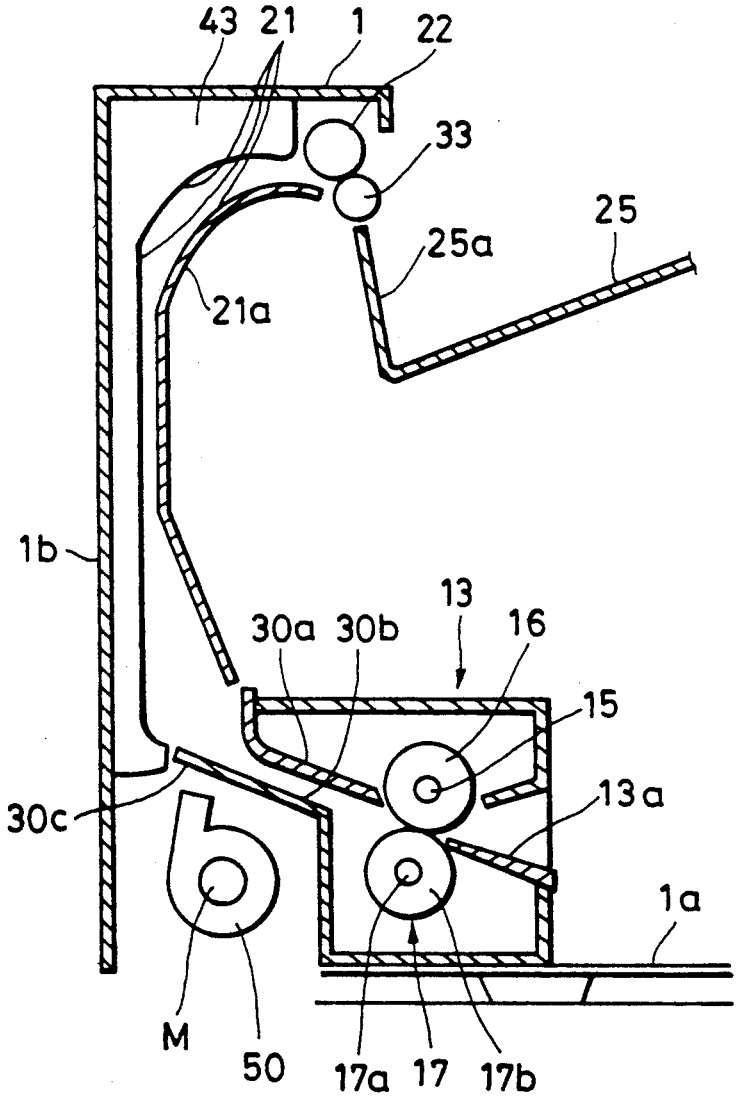
FIG. 9 is a cross-sectional side view of a discharged sheet conveying device according to still another embodiment of the present invention.
Figure 10:
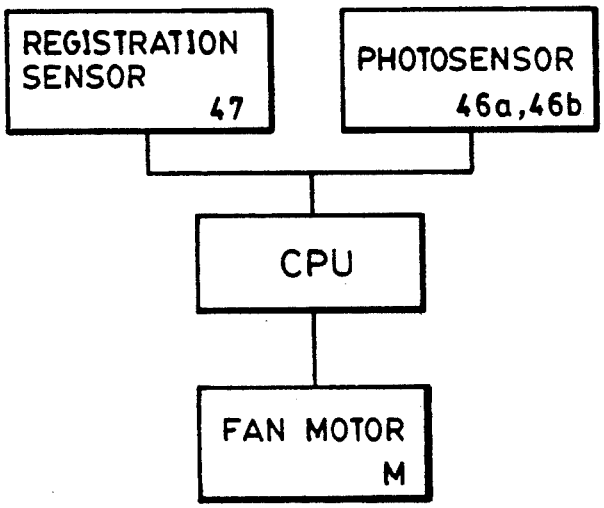
FIG. 10 is a block diagram according to still another embodiment of the present invention.
Figure 11:
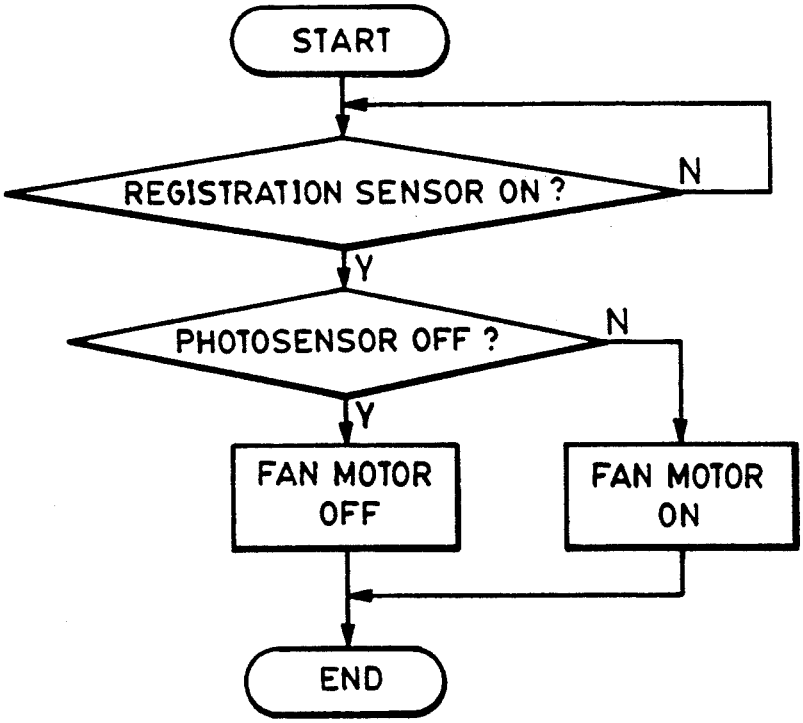
FIG. 11 is a flowchart according to still another embodiment of the present invention.

The above-described embodiments are configured so that air is introduced within the conveying path by opening the conveying path. Alternatively, as shown in FIG. 9, a grid-like window 30*c* may be provided in the exit guide 30*b*, and air may be forcibly ventilated into the conveying path using, for example, a fan 50 driven by a motor M. When the fan 50 is used, the motor M, serving as a driving source, may be switched using a manual switch, or automatically switched by detecting the transparency of the sheet by the photosensor 46*a* and 46*b* using a control circuit and a flowchart shown in FIGS. 10 and 11, respectively.

Although, in the above-described embodiments, part of the guide plate is opened in order to introduce air within the conveying path, the position to open air flow may be arbitrarily selected. Alternatively, a grid-like sheet discharge guide may be provided so as to guide the sheet and freely introduce air, and the case of the device may be opened and closed.

Although, in the above-described embodiments, the two side end portions of the sheet conveying path is closed by the frame or case of the device, one side of the frame or case may be openably provided so that air can be introduced from a side portion of the sheet conveying path.

In the above-described embodiments, the photosensing device 46*a* of the photosensor may comprise a photoelectric conversion device which generates a voltage in proportion to the amount of incident light. In this case, even paper transmits some light, though much less than an OHP sheet. Hence, the photoelectric conversion device will generate a voltage in proportion to the amount of received light. Accordingly, a predetermined value of voltage (a threshold value) corresponding to a border between paper and an OHP sheet may be experimentally set in order to determine the material of the sheet in accordance with the voltage generated in the photoelectric conversion device. For that purpose, a comparison circuit which generates different signals when the voltage generated in the photoelectric conversion device exceeds and does not exceed the predetermined value may be provided. the solenoid 43 or the fan motor M may be subjected to on/off control according to the signal from the comparison circuit.

While the present invention has been described with respect to what is presently considered to be the preferred embodiments, it is understood that the invention is not limiated to the disclosed embodiments. The present invention is intended to cover various modifications and equivalent arrangements included within the spirit and scope of the appended claims.

What is claimed is:

1. A sheet conveying device comprising:

fixing means for fixing an image formed on a sheet of a material by heating the sheet;

a conveying path for guiding the sheet on which the image has been fixed by said fixing means, said path having at least one curved portion; and changeable cooling means for selectively cooling the sheet guided along said conveying path in accordance with the material of said sheet.

2. A sheet conveying device according to claim 1, wherein said fixing means comprises a pair of rotating members for grasping and conveying the sheet.

3. A sheet conveying device according to claim 1, wherein said conveying path comprises guiding members for guiding the sheet.

4. A sheet conveying device according to claim 1, wherein said cooling means comprises an openable and closable member which selectively opens and closes a passage for introducing air within said conveying path.

5. A sheet conveying device according to claim 4, wherein said openable and closable member introduces air from outside said conveying path to within the conveying path by exposing a part of the conveying path.

6. A sheet conveying device according to claim 5, further comprising an operation member for manually operating said openable and closable member.

7. A sheet conveying device according to claim 5, wherein said cooling means further comprises an actuator for operating said openable and closable member.

8. A sheet conveying device according to claim 1, wherein said cooling means comprises ventilation means for selectively generating an air flow within said conveying path.

9. A sheet conveying device according to claim 1, wherein said conveying path has at least one curved portion.

10. A sheet conveying device comprising:

fixing means for fixing an image formed on a sheet by heating the sheet;

a conveying path for guiding the sheet on which the image has been fixed by said fixing means, said path having at least one curved portion;

cooling means for selectively cooling the sheet guided along said conveying path while in said conveying path;

material detection means for detecting at least one characteristic of the material of the sheet on which the image has been fixed by said fixing means; and control means for controlling said cooling means in accordance with the detection by said material detection means.

11. A sheet conveying device according to claim 10, wherein said fixing means comprises a pair of rotating members for grasping and conveying the sheet.

12. A sheet conveying device according to claim 10, wherein said conveying path comprises guiding members for guiding the sheet.

13. A sheet conveying device according to claim 10, wherein said cooling means comprises an openable and closable member which selectively opens and closes a passage for introducing air to within said conveying path.

14. A sheet conveying device according to claim 13, wherein said openable and closable member introduces air from outside said conveying path to within the conveying path by exposing a part of the conveying path.

15. A sheet conveying device according to claim 14, wherein said cooling means comprises an actuator for operating said openable and closable member.

16. A sheet conveying device according to claim 15, wherein said control means controls said actuator in accordance with the detection by said material detection means.

17. A sheet conveying device according to claim 10, wherein said cooling means comprises ventilation means for selectively generating an air flow within said conveying path.

18. A sheet conveying device according to claim 17, wherein said control means controls said ventilation means in accordance with the detection by said material detection means.

19. A sheet conveying device comprising:

fixing means for fixing an image formed on a sheet by heating the sheet;

a conveying path for guiding the sheet on which the image has been fixed by said fixing means, said path having at least one curved portion;

cooling means for selectively cooling the sheet guided along said conveying path while in said conveying path;

transparency detection means for detecting light transmitted through the sheet on which the image has been fixed by said fixing means; and control means for controlling said cooling means in accordance with the light detected by said transparency detection means.

20. A sheet conveying device according to claim 19, wherein said fixing means comprises a pair of rotating members for grasping and conveying the sheet.

21. A sheet conveying device according to claim 19, wherein said conveying path comprises guiding members for guiding the sheet.

22. A sheet conveying device according to claim 19, wherein said cooling means comprises an openable and closable member which selectively opens and closes a passage for introducing air within said conveying path.

23. A sheet conveying device according to claim 22, wherein said openable and closable member introduces air from outside said conveying path to within the conveying path by exposing a part of the conveying path.

24. A sheet conveying device according to claim 23, wherein said cooling means comprises an actuator for operating said openable and closable member.

25. A sheet conveying device according to claim 24, wherein said control means controls said actuator in accordance with the detection by said transparency detection means.

26. A sheet conveying device according to claim 25, wherein said control means controls said actuator so as to close said openable and closable means when said transparency detection means has detected that the sheet easily transmits light, and to open said openable and closable means when said transparency detection means has detected that the sheet transmits only a minimal amount of light.

27. A sheet conveying device according to claim 19, wherein said cooling means comprises ventilation means for selectively generating an air flow within said conveying path.

28. A sheet conveying according to claim 27, wherein said control means controls said ventilation means in accordance with the detection by said transparency detection means.

29. A sheet conveying device according to claim 28, wherein said control means turns off said ventilation means when said transparency detection means has detected that the sheet easily transmits light, and turns on said ventilation means when said transparency detection means has detected that the sheet transmits only a minimal amount of light.

30. A sheet conveying device comprising:

image forming means for forming an image on a sheet of a material;

fixing means for fixing the image formed on the sheet by said image forming means by heating the sheet;

a conveying path for guiding the sheet on which the image has been fixed by said fixing means, said path having at least one curved portion; and changeable cooling means for selectively cooling the sheet guided along said conveying path in accordance with the material of the sheet.

31. A sheet conveying device comprising:

image forming means for forming an image on a sheet;

fixing means for fixing the image formed on the sheet by said image forming means by heating the sheet;

a conveying path for guiding the sheet fixed by said fixing means, said path having at least one curved portion;

cooling means for selectively cooling the sheet guided along said conveying path while in said conveying path;

material detection means for detecting at least one characteristic of the material of the sheet on which the image has been fixed by said fixing means; and control means for controlling said cooling means in accordance with the detection by said material detection means.

32. A sheet conveying device comprising:

image forming means for forming an image on a sheet;

fixing means for fixing the image formed on the sheet by said image forming means by heating the sheet;

a conveying path for guiding the sheet fixed by said fixing means, said path having at least one curved portion;

cooling means for selectively cooling the sheet guided along said conveying path while in said conveying path;

transparency detection means for detecting light transmitted through the sheet on which the image has been fixed by said fixing means; and control means for controlling said cooling means in accordance with a detected amount of light by said transparency detection means.

* * * * *

UNITED STATES PATENT AND TRADEMARK OFFICE

CERTIFICATE OF CORRECTION

PATENT NO. : 5,218,411

DATED : June 8, 1993

INVENTOR(S) : OTOYA KOSUGIYAMA, ET AL.

It is certified that error appears in the above-indentified patent and that said Letters Patent is hereby corrected as shown below:

Drawings:

SHEET 6

Fig. 7, "RESISTRATION" should read --REGISTRATION--.

Title page, item,

[75] Inventors

Line 2, "Tsunashimahigashi;" should read --Yokohama;--.

COLUMN 3

Line 18, "rolle," should --roller,--.
Line 20, "rolle," should --roller,--.
Line 37, "discharged" should read --discharge--.
Line 40, "When, the" should read --When the--.
Line 50, "crossed-sectional" should read --cross-sectional--.

COLUMN 4

Line 13, "by" should read --be--.

COLUMN 5

Line 33, "advantages a" should read --advantages that a--.
Line 57, "A still" should read --Still--.

UNITED STATES PATENT AND TRADEMARK OFFICE

CERTIFICATE OF CORRECTION

PATENT NO. : 5,218,411 Page 2 of 2

DATED : June 8, 1993

INVENTOR(S) : OTOYA KOSUGIYAMA, ET AL.

It is certified that error appears in the above-indentified patent and that said Letters Patent is hereby corrected as shown below:

COLUMN 7

Line 63, "limiated" should read --limited--.

COLUMN 10

Line 5, "sheet conveying" should read --sheet conveying device"

Signed and Sealed this

Fifth Day of April, 1994

Bruce Lehman

*Attest:*

BRUCE LEHMAN

*Attesting Officer*

*Commissioner of Patents and Trademarks*